United States Patent [19]

Keating et al.

[11] Patent Number: 4,747,290

[45] Date of Patent: May 31, 1988

[54] ROLLER COOLING TABLE

[75] Inventors: Peter Keating; Kenneth Lyall, both of Mayfield, Australia

[73] Assignee: Tubemakers of Australia Pty., Ltd., Newcastle, Australia

[21] Appl. No.: 770,348

[22] PCT Filed: Dec. 20, 1984

[86] PCT No.: PCT/AU84/00265

§ 371 Date: Jun. 23, 1986

§ 102(e) Date: Jun. 23, 1986

[87] PCT Pub. No.: WO85/02796

PCT Pub. Date: Jul. 4, 1985

[30] Foreign Application Priority Data

Dec. 20, 1983 [AU] Australia ..... PG2909

[51] Int. Cl.[4] ..... B21B 43/04; B21B 45/02

[52] U.S. Cl. ..... 72/201; 266/260

[58] Field of Search ..... 72/200, 201, 251, 202; 198/782, 784, 789; 266/259, 260, 117; 148/155, 156

[56] References Cited

U.S. PATENT DOCUMENTS

| | | | |
|---|---|---|---|
| 691,159 | 1/1902 | Morgan | 72/201 |
| 744,874 | 11/1903 | Neeland | 266/259 X |
| 1,750,534 | 3/1930 | McArthur | 72/202 |
| 1,761,199 | 6/1930 | Drake | 198/782 |
| 3,534,575 | 10/1970 | DeCorta | 72/201 |

FOREIGN PATENT DOCUMENTS

| | | | |
|---|---|---|---|
| 3005116 | 8/1981 | Fed. Rep. of Germany | 72/201 |
| 425058 | 3/1911 | France | 266/260 |

*Primary Examiner*—E. Michael Combs

*Attorney, Agent, or Firm*—Townsend and Townsend

[57] ABSTRACT

A roll cooling table (1) for steel pipes (3) having a group of interlocked castellated water-cooled rolls (5) which are located in a generally downwardly sloping plane at the entry side of the cooling table (1), and being situated adjacent to a sloping skid pan (11) of a kick-off table (6).

5 Claims, 3 Drawing Sheets

ROLLER COOLING TABLE

The present invention relates to a roller cooling table.

In steel pipe production, mother tube is fed into a stretch reducing mill, and the finished pipes cut into desired lengths leave the stretch reducing mill at temperatures ranging from 850° C. to 1000° C. approximately.

The finished pipes are then fed into a cooling table. As shown in FIG. 1 a conventional cooling table 1 consist of a horizontal array of water cooled rolls 2 onto which the hot finished pipes 3 are fed where upon the pipes 3 are rotated and transported to the exit side of the table and discharged in a straight cool condition. A typical cooling table could consist of 48 water cooled pipes 330 mm in diameter and 8.6 m in length. The roll diameters, number of rolls, length of table, speed of rotation, and flow of cooling water are chosen to achieve the desired rate of cooling for the intended range of pipe sizes and output rates.

In operation, depending upon the size of the pipes to be cooled, the pipes 1 rotate in the V-spaces 4 between adjacent rolls 2 in twos or threes and are moved one at a time into the adjacent V-spaces by an additional pipe being transported into the particular V-space.

A problem with these conventional cooling tables is that small size pipes, such as 15 and 20 mm nominal bore, do not always remain parallel and straight, but become entangled with each other and cool in a bent condition, requiring re-straightening. Thus reducing the efficiency of the operation.

The present invention seeks to ameliorate this problem by providing a roller cooling table having at least a first group of rollers at the entrance side of the table located in a generally downwardly sloping plane.

Preferably the first rollers are smaller in diameter than the remaining group of rollers.

The invention will now be described by way of example with reference to the accompanying drawings in which.

Figure 1:
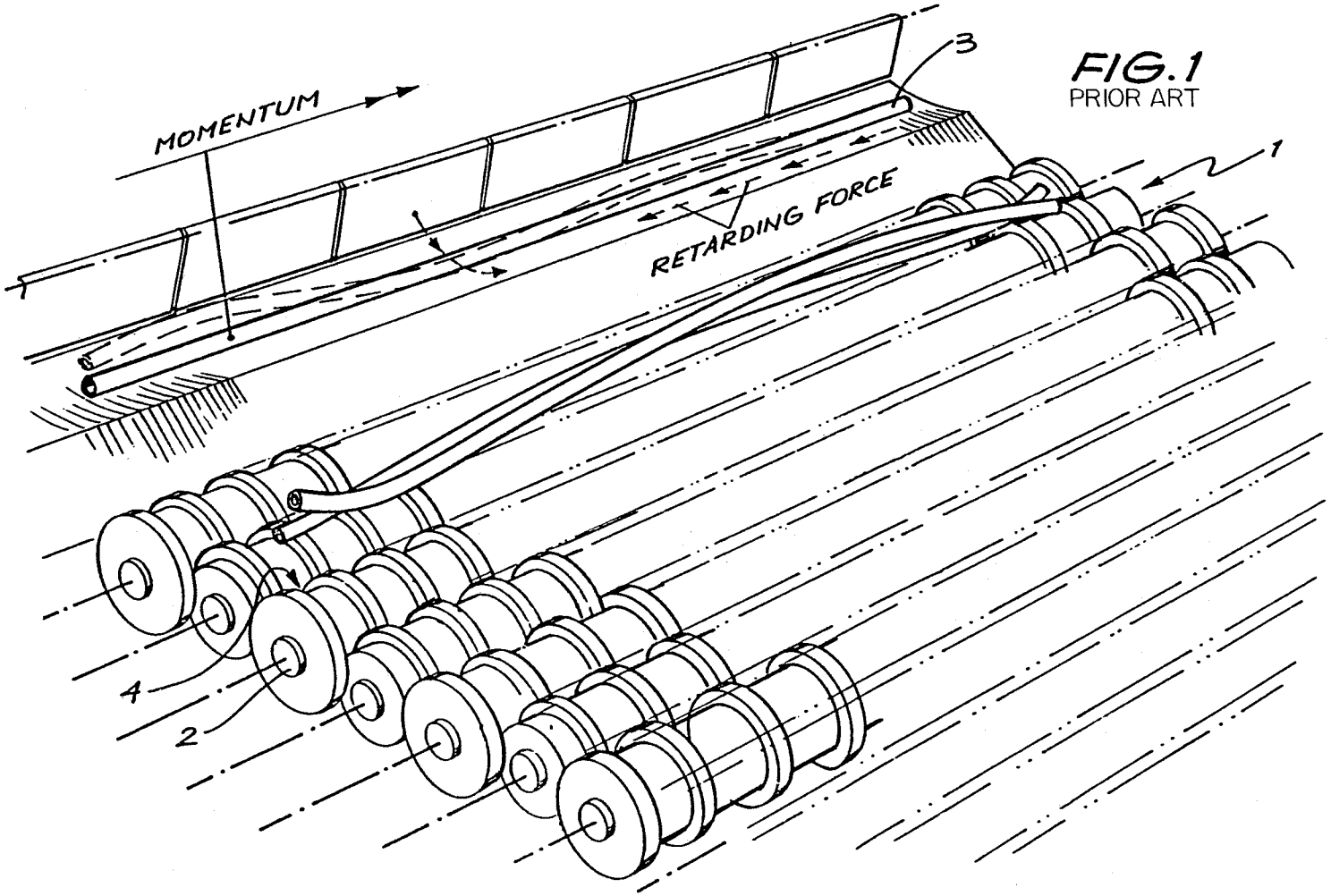
FIG. 1 PRIOR ART
FIG. 1 shows a conventional cooling table including water-cooled rolls upon which hot finished pipes are fed.
Figure 2:
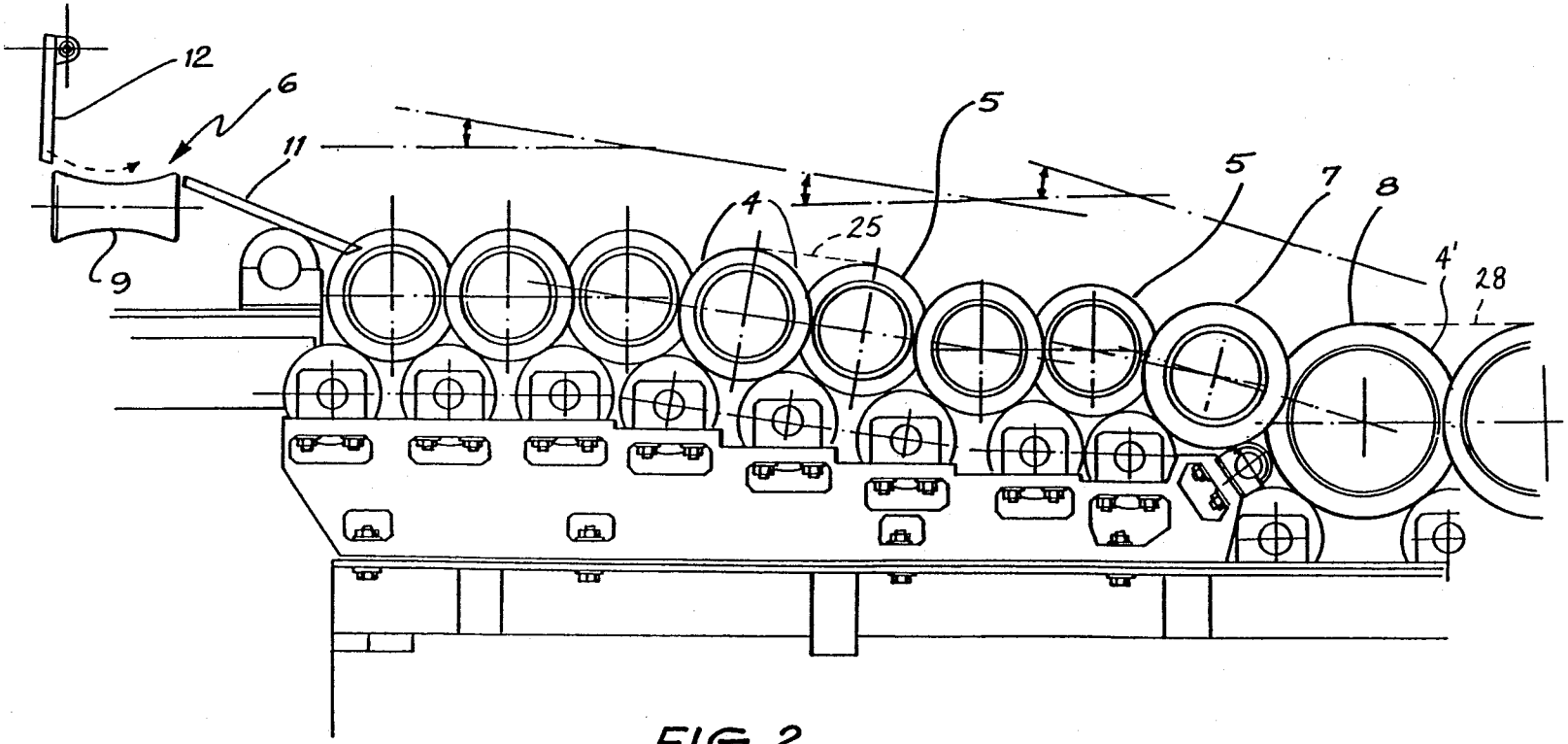
FIG. 2 illustrates the first group of rolls of one embodiment of the present invention.

As shown in FIG. 2 the cooling table comprises interlocked castellated water cooled rolls 5, the first seven rolls 5, adjacent the kick-off table 6 are 220 mm in diameter, with the eighth roll 7 being 243 mm in diameter. These rolls are arranged in a generally downwardly sloping plane, and are followed by a horizontal array of 330 mm diameter rolls 8. The spaces 4, 4' are defined by the peripheries of adjacent rolls 5, 8 and tangent lines 25, 28, respectively, as shown in FIG. 2, V-space 4 being smaller than V-space 4'.

The sloping of the plane of the first rolls reduces the number of pipes that can be held in the V-space 4 between rolls 5 and uses gravity to assist forward pipe travel. The use of the smaller rolls in the first group of rolls adjacent the kick-off 6 from the stretch reducing mill runout further reduces the number of pipes in the V-spaces between rolls.

To allow for better control of the forward movement of the pipes in the early stages, where pipe straightening is most effective, a variable speed drive can be fitted to the rolls on the entry side of the table.

In conventional designs of the kick-off from the stretch reducing mill, hot pipes at high longitudinal speed leaving the flying cut-off after the stretch reducing mill have to be kicked off conveyor rolls in the runout and slowed to longitudinal rest by friction braking both initially on a sloping skid plate and finally in the V-space between the skid plate and the first cooling table roll. Larger pipes at lower speeds can be kicked off by the five paddles 12*a* and gear box drives in line with the roller cooling table 1, since little longitudinal braking is necessary. Smaller pipes at higher speeds need earlier kick-off (for which four additional paddles 12*b* and gear box drives were required upstream of the five aligned with the roller cooling table) to allow space for braking to a consistent position before travelling across the cooling table.

In the absence of any arresting means, the tail of the hot small pipe was found to bounce and bend ahead, predisposing it to become entangled with its neighbouring pipes. An overhanging pendulum stop bar suspended above the first cooling table roll proved satisfactory only with careful height adjustment and repeated careful readjustment with changes of pipe.

Figure 3:
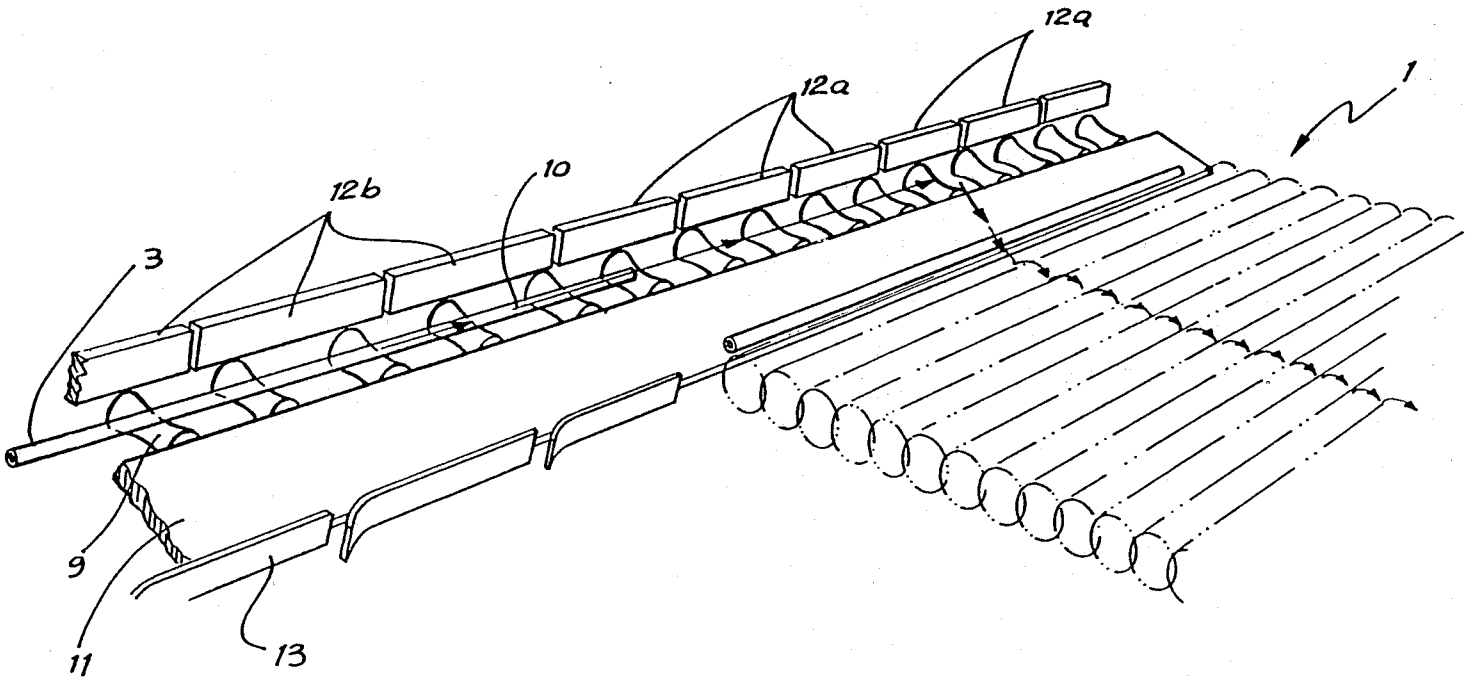
FIG. 3 illustrates a stretch reducing mill runout of an embodiment of the present invention.

In an embodiment of the present invention, diagrammatically illustrated in FIG. 3, the pipes 3 leave the stretch reducing mill on the runout 9 and travel in the direction of the arrow 10. The paddles 12 are used to kick-off the pipe down the sloping skid plate 11 to come to a longitudinal rest abutting against the first roll of the cooling table.

The addition of the arrestor plates 13 for pipes travelling along the stretch reducing mill runout conveyor at speeds above 4.5 m/s present the following advantages:

- overcomes the difficulty of fine adjustment of the prior art suspended bar;
- prevents the pipe tail from bending ahead thereby lessening the risk of entanglement; and
- provides more effective braking thereby allowing removal and use as spares of two paddles and gear box drives. The space required could be saved in future installations, moreover the necessity to engage and disengage gear boxes to extend and reduce length of paddles in unison motion (a task for which it is essential to interrupt production) has been reduced.

It should of course be obvious to people skilled in the art that variations can be made to the above description without departing from the spirit or scope of the present invention.

We claim:

1. A roller cooling table for straightening and cooling hot-rolled tubes, comprising, a series of hollow rolls with their axes substantially horizontal and parallel, and positioned adjacent one another;

means for feeding hot-rolled tubes in a plastic or semi-plastic condition onto said roller cooling table with the axes of said tubes parallel to the axes of said hollow rolls;

a first group of said rolls, located at an entry end of said table, arranged in a downwardly sloping plane;

a second group of said rolls, located downstream of the first group of said rolls, arranged in a substantially horizontal plane, the rolls of the first group having smaller diameters than the diameters of the rolls of the second group;

the first and second groups of rolls defining first and second v-shaped spaces, respectively, between all adjacent ones of said rolls, the first v-shaped spaces being samller than the second v-shaped spaces; and means for rotating at least some of said rolls in the same direction, whereby said hot-rolled tubes in plastic to semi-plastic conditions are partially cooled and straightened in the first group of rolls and are further cooled and straightened on passage over the second group of rolls.

2. The roller cooling table of claim 1 further comprising variable speed drives for rotating at least some of the rolls in the first group of rolls.

3. The roller cooling table of claim 1 further comprising a kick-off table including paddles aligned with the first group of rolls, additional paddles offset from the first group of rolls, and arrestor plates spaced apart from and opposite the additional paddles.

4. The roller cooling table of claim 1 further comprising a third group of rolls positioned between the first and second groups of rolls and having a diameter between the diameters of the first and second groups of rolls.

5. The roller cooling table of claim 4 wherein a single roll constitutes the third group of rolls.

* * * * *